US012134814B2

(12) United States Patent
Jiang et al.

(10) Patent No.: US 12,134,814 B2
(45) Date of Patent: Nov. 5, 2024

(54) Cu—Ni—Si-BASED COPPER ALLOY SHEET MATERIAL, METHOD FOR PRODUCING SAME, AND CURRENT-CARRYING COMPONENT

(71) Applicant: DOWA METALTECH CO., LTD., Tokyo (JP)

(72) Inventors: Wanqing Jiang, Tokyo (JP); Hiroshi Hyodo, Tokyo (JP); Hisashi Suda, Tokyo (JP); Akira Sugawara, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 147 days.

(21) Appl. No.: 17/785,069

(22) PCT Filed: Dec. 23, 2020

(86) PCT No.: PCT/JP2020/048167
§ 371 (c)(1),
(2) Date: Jun. 14, 2022

(87) PCT Pub. No.: WO2021/140915
PCT Pub. Date: Jul. 15, 2021

(65) Prior Publication Data

US 2023/0018758 A1 Jan. 19, 2023

(30) Foreign Application Priority Data

Jan. 9, 2020 (JP) ..... 2020-002365
Dec. 17, 2020 (JP) ..... 2020-209551

(51) Int. Cl.
*C22F 1/08* (2006.01)
*C22C 9/06* (2006.01)

(52) U.S. Cl.
CPC . *C22F 1/08* (2013.01); *C22C 9/06* (2013.01)

(58) Field of Classification Search
None
See application file for complete search history.

(56) References Cited

U.S. PATENT DOCUMENTS

2017/0016102 A1* 1/2017 Nakanishi ..... C22F 1/002
2019/0010593 A1* 1/2019 Park ..... C22F 1/08
2020/0140982 A1* 5/2020 Hyodo ..... C22C 9/00

FOREIGN PATENT DOCUMENTS

JP 2006-152392 6/2006
JP 2011-052316 3/2011

(Continued)

*Primary Examiner* — Xiaobei Wang
(74) *Attorney, Agent, or Firm* — Bauer & Joseph

(57) ABSTRACT

A copper alloy sheet material having improved etching characteristics contains (in mass %) Ni: 1.00 to 4.50%, Si: 0.10 to 1.40%, and optionally one or more kind of Co, Mg, Cr, P, B, Mn, Sn, Ti, Zr, Al, Fe, Zn, and Ag. The sheet material has an area ratio $S_B/S_s$ of 0.40 or more in an EBSD measurement on a cross section perpendicular to a rolling direction, wherein $S_s$ represents area of a region satisfying at least one of conditions of a crystal orientation difference from the S1 {241} <112>orientation of 10° or less or a crystal orientation difference from the S2 {231}<124>orientation of 10° or less, and $S_B$ represents an area of a region having a crystal orientation difference from the Brass {011}<211>orientation of 10° or less.

10 Claims, 2 Drawing Sheets

(56) References Cited

FOREIGN PATENT DOCUMENTS

| | | |
|---|---|---|
| JP | 2012-126930 | 7/2012 |
| JP | 2012-177153 | 9/2012 |
| JP | 2018-035437 | 3/2018 |
| JP | 2018-062694 | 4/2018 |
| JP | 2018-168438 | 11/2018 |
| JP | 2018-178243 | 11/2018 |
| JP | 2019-077889 | 5/2019 |

* cited by examiner

[Fig.1]
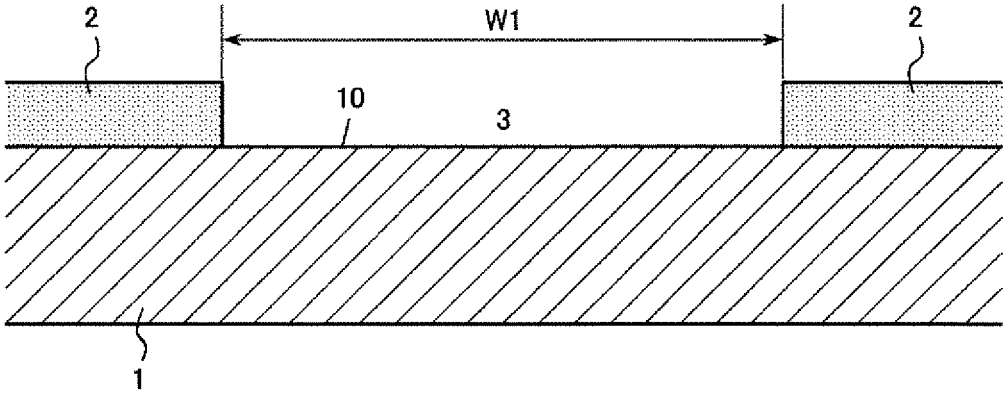
[Fig.2]
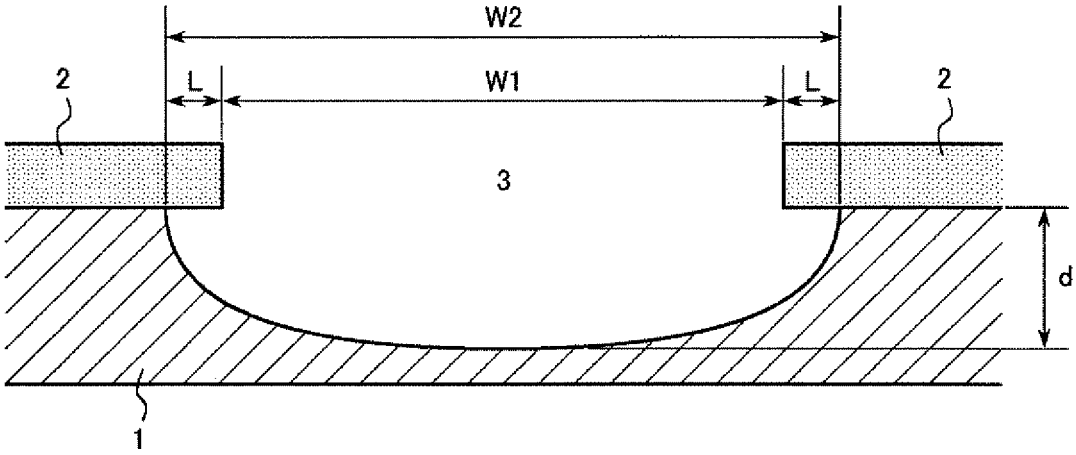
[Fig.3]
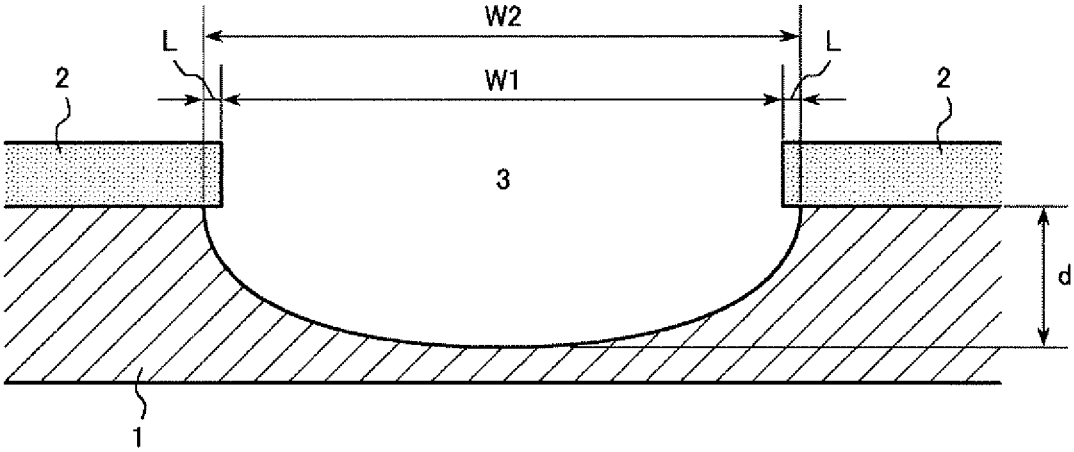

[Fig.4]
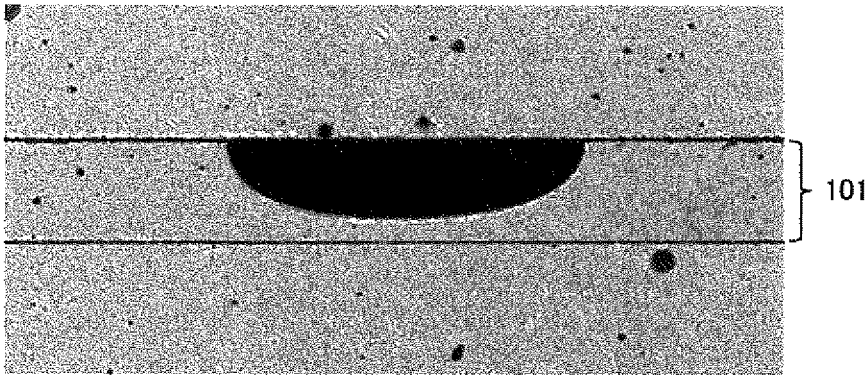

Cu—Ni—Si-BASED COPPER ALLOY SHEET MATERIAL, METHOD FOR PRODUCING SAME, AND CURRENT-CARRYING COMPONENT

TECHNICAL FIELD

The present invention relates to a Cu—Ni—Si-based copper alloy sheet material improved in etching capability and a method for producing the same, and also to a current-carrying component using the Cu—Ni—Si-based copper alloy sheet material.

BACKGROUND ART

A Cu—Ni—Si-based copper alloy has a relatively good balance between strength and conductivity among the copper alloys, and is useful as current-carrying components, such as a connector and a lead frame, and heat radiation components of electronic devices. The current-carrying components and the heat radiation components have been frequently produced through press punching of a sheet material. In recent years, there is an increasing need of the production of products through etching, associated with the reduction in size and the complication in structures of the components. In response thereto, it is necessary to produce a component having a high shape accuracy through precision etching, and the material therefor is demanded to provide an etched surface having unevenness as little as possible (i.e., having better surface smoothness).

Some proposals have been made for the improvement in etching capability of a Cu—Ni—Si-based copper alloy (see, for example, PTLs 1 to 3 described later). However, according to the increase of the number of pins and the decrease of the pitch thereof of semiconductor packages in these days, the material for a lead frame is being demanded to have an etching capability capable of achieving a pin distance of approximately 300 μm or less. In etching a slit part of a resist film, the etching proceeds not only in the depth direction but also in the width direction of the slit (i.e., the direction toward below the resist film), and therefore the distance of pins formed after etching generally becomes larger than the slit width of the resist film. In the case where the pin width is larger, the adverse influence in dimensional accuracy due to the progress of etching in the width direction of the slit can be avoided, for example by optimizing the slit size. However, for achieving a narrow pitch with a pin distance of approximately 300 μm or less, it is demanded to apply a copper alloy sheet material that has "characteristics that the material is easily etched in the depth direction but is not easily etched in the width direction of the slit". In the description herein, the aforementioned characteristics are evaluated by introducing an index referred to as an "etching factor" as described later. A material having a larger etching factor is evaluated as excellent in the aforementioned characteristics. The calculation example of the etching factor based on the same etching condition will be described later.

PTL 1 describes a technique of producing a sheet material having a metal structure state having a large KAM value, through the steps of subjecting a Cu—Ni—Si-based copper alloy to a solution treatment, intermediate cold rolling, an aging treatment, finish cold rolling, shape correction with a tension leveler, and low temperature annealing, so as to improve the smoothness of the etched surface. However, the elongation ratio applied with the tension leveler is smaller than the technique of the present invention described later, and there is no description about the atmosphere in the low temperature annealing.

PTL 2 describes a technique of producing a sheet material having a metal structure state having a large integration degree in the Brass orientation, through the steps of subjecting a Cu—Ni—Si-based copper alloy sheet material containing Co to a special solution treatment that also serves as a precursor treatment of aging, an aging treatment, finish cold rolling, and low temperature annealing, so as to improve the smoothness of the etched surface. The step using a tension leveler is not described.

PTL 3 describes a technique of producing a crystal orientation having a polar density of the crystal orientations in all the Euler angles of 12 or less, through the steps of subjecting a Cu—Ni—Si-based copper alloy to a solution treatment, an aging treatment, a diffusion treatment at 220 to 280° C., cold rolling, and stress relief annealing, so as to improve the surface unevenness and the dimensional accuracy after etching. The step using a tension leveler is not described.

The techniques of PTLs 1 to 3 provide an effect of improving the smoothness of the etched surface, and thereby it is considered that the dimensional accuracy after etching is also improved. However, these techniques cannot sufficiently improve the etching factor described above. Therefore, these techniques are not sufficiently satisfactory for the improvement in etching accuracy looking ahead to the decrease of the pitch in these days.

Techniques for controlling the texture of the sheet material have been variously investigated for improving the strength, the conductivity, the bending workability, the stress relaxation resistance characteristics, and the like of a Cu—Ni—Si-based copper alloy in a well balanced manner.

For example, PTL 4 describes a technique of providing a metal structure state having a large average area ratio of the Cube orientation and a large KAM value, by utilizing the step of performing a solution treatment twice with cold rolling intervening therebetween. The step using a tension leveler is not described therein.

PTL 5 describes a technique of regulating to a texture having an average area ratio of the Cube {001} <100> orientation of 20% or more and an average total area ratio of the three orientations, i.e., the Brass {011} <211> orientation, the S {123} <634> orientation, and the Copper {112} <111> orientation, of 40% or less, by utilizing a two-step solution treatment. The step using a tension leveler is not described.

PTL 6 describes a technique of regulating to a texture having a ratio of Cube orientation of 50% or more, by a method of performing finish cold rolling twice with the final solution treatment intervening therebetween. The step using a tension leveler is not described therein.

The textures shown in PTLs 4 to 6 cannot sufficiently improve the etching factor described above.

CITATION LIST

Patent Literatures

PTL 1: JP-A-2018-35437
PTL 2: JP-A-2018-62694
PTL 3: JP-A-2018-168438
PTL 4: JP-A-2012-177153
PTL 5: JP-A-2011-52316
PTL 6: JP-A-2006-152392

SUMMARY OF INVENTION

Technical Problem

As described above, the control of the texture of the Cu—Ni—Si-based copper alloy sheet material has been variously investigated, and the proposals of the improvement of the etching capability thereby have been made. However, the decrease of the pitch of the semiconductor packages proceeds in recent years, and there are an increasing number of applications that cannot secure the sufficient etching accuracy by the ordinary Cu—Ni—Si-based copper alloy sheet materials.

A problem to be solved by the present invention is to provide a Cu—Ni—Si-based copper alloy sheet material that is excellent in "characteristics that the material is easily etched in the depth direction but is not easily etched in the width direction of the slit" (i.e., has a large etching factor), which are advantageous for providing a high dimensional accuracy in etching with an extremely narrow pitch.

Solution to Problem

The following matters have been found from the investigations made by the present inventors.

(i) For identifying the texture that can stably provide a high etching factor, it is necessary to deal with not only the surface (rolled surface) of the sheet but also the crystal orientation of the "inside" of the sheet on the cross section including the sheet thickness direction.

(ii) As for the crystal orientation of the "inside", it is significantly effective to control to provide a crystal orientation having an area ratio $S_B/S_s$ of 0.40 or more, wherein $S_s$ represents an area of a region satisfying at least one of conditions of a crystal orientation difference from the S1 {241}<112>orientation of 10° or less or a crystal orientation difference from the S2 {231}<124>orientation of 10° or less, and $S_B$ represents an area of a region having a crystal orientation difference from the Brass {011}<211>orientation of 10° or less.

(iii) For providing more stably a high etching factor, it is effective to provide an appropriately high crystal lattice strain with excellent uniformity. Specifically, it is preferred to provide a metal structure state having a KAM (Kernel Average Misorientation) value of 2.00° or more measured under a condition with a minute step size of 0.05 μm by EBSD.

(iv) For producing a sheet material exhibiting the aforementioned high etching factor, it is significantly effective that a deformation with an elongation ratio of more than 1.5% and 3.7% or less is imparted with a tension leveler after the final finish cold rolling, and a mixed gas of hydrogen gas and an inert gas having a hydrogen concentration of 3 to 13% by volume is used as a gas atmosphere for low temperature annealing.

The present invention has been completed based on these findings.

The following inventions are described in the description herein.

[1] A copper alloy sheet material having a chemical composition containing, in terms of percentage by mass, Ni: 1.00 to 4.50%, Si: 0.10 to 1.40%, Co: 0 to 2.00%, Mg: 0 to 0.50%, Cr: 0 to 0.50%, P: 0 to 0.20%, B: 0 to 0.20%, Mn: 0 to 1.00%, Sn: 0 to 1.00%, Ti: 0 to 0.50%, Zr: 0 to 0.30%, Al: 0 to 1.00%, Fe: 0 to 1.00%, Zn: 0 to 1.00%, Ag: 0 to 0.30%, Be: 0 to 0.15%, and balance of Cu, with unavoidable impurities, having an area ratio $S_B/S_s$ of 0.40 or more in an EBSD (electron backscatter diffractometry) measurement in a measurement region provided in a range of from a ¼ sheet thickness position to a ¾ sheet thickness position on a cross section extending in a sheet thickness direction and perpendicular to a rolling direction, wherein $S_s$ represents an area of a region satisfying at least one of conditions of a crystal orientation difference from the S1 {241}<112>orientation of 10° or less or a crystal orientation difference from the S2 {231}<124>orientation of 10° or less, and $S_B$ represents an area of a region having a crystal orientation difference from the Brass {011}<211>orientation of 10° or less.

[2] The copper alloy sheet material according to the item [1], wherein the copper alloy sheet material has a KAM value of 2.00° or more measured at a step size of 0.05 μm inside a crystal grain assuming a boundary of a crystal orientation difference of 15° or more in the EBSD measurement as a crystal grain boundary.

[3] The copper alloy sheet material according to the item [1] or [2], wherein the copper alloy sheet material has an average crystal grain size of 2.00 μm or less obtained by an area fraction method assuming a boundary of a crystal orientation difference of 15° or more in the EBSD measurement as a crystal grain boundary.

[4] The copper alloy sheet material according to any one of the items [1] to [3], wherein the copper alloy sheet material has a number density of fine second phase particles having a particle diameter of 20 to 30 nm existing in a matrix of the copper alloy sheet material of $1.0\times10^7$ per $mm^2$ or more, and a number density of coarse second phase particles having a particle diameter of 0.5 μm or more existing in the matrix of $5.0\times10^5$ per $mm^2$ or less.

[5] The copper alloy sheet material according to any one of the items [1] to [4], wherein the copper alloy sheet material has a tensile strength in a direction in parallel to the rolling direction of 600 MPa or more.

[6] The copper alloy sheet material according to any one of the items [1] to [5], wherein the Co content is 0.50 to 2.00% by mass in the chemical composition.

[7] The copper alloy sheet material according to any one of the items [1] to [6], wherein the copper alloy sheet material has a sheet thickness of 0.04 to 0.30 mm.

[8] A method for producing the copper alloy sheet material according to any one of the items [1] to [7], including subjecting an intermediate product sheet material to a solution treatment, intermediate cold rolling, an aging treatment, finish cold rolling, pass through a tension leveler, and low temperature annealing, in this order, the solution treatment being performed under a condition of retaining at 780 to 1,060° C. for 10 to 80 seconds, the intermediate cold rolling and the finish cold rolling being performed under a condition satisfying at least one of cold rolling conditions A or B, wherein $R_1$ (%) represents a rolling reduction ratio in the intermediate cold rolling, $R_2$ (%) represents a rolling reduction ratio in the finish cold rolling, and $R_T$ (%) represents a total rolling reduction ratio in the intermediate cold rolling and the finish cold rolling, the aging treatment being performed under a condition causing no recrystallization, before the finish cold rolling, the pass through a tension leveler being performed under a condition providing an elongation ratio of more than 1.5% and 3.7% or less, the low temperature annealing being performed under a condition of retaining at 380 to 550° C. for 10 to 620 seconds in a mixed gas atmosphere of hydrogen gas and an inert gas having a hydrogen concentration of 3 to 13% by volume:

(cold rolling condition A)

$R_1 \geq 50\%$, $R_2 \geq 25\%$, and $R_T \geq 75\%$ are satisfied (cold rolling condition B)

$R_1 \geq 60\%$, $R_2 \geq 18\%$, and $R_T \geq 90\%$ are satisfied.

[9] The method for producing the copper alloy sheet material according to the item [8], wherein the intermediate product sheet material is a sheet material subjected to hot rolling and then cold rolling.

[10] A current-carrying component including the copper alloy sheet material according to any one of the items [1] to [7].

The following invention of the item [1]', in which the chemical composition in the item [1] is further limited, is described in the description herein. The inventions of the items [2] to [10] each may refer to the item [1]' instead of the item [1].

[1]' A copper alloy sheet material having a chemical composition containing, in terms of percentage by mass, Ni: 1.00 to 4.50%, Si: 0.10 to 1.20%, Co: 0 to 2.00%, Mg: 0 to 0.30%, Cr: 0 to 0.20%, P: 0 to 0.10%, B: 0 to 0.05%, Mn: 0 to 0.20%, Sn: 0 to 1.00%, Ti: 0 to 0.50%, Zr: 0 to 0.20%, Al: 0 to 0.20%, Fe: 0 to 0.30%, Zn: 0 to 1.00%, Ag: 0 to 0.20%, and balance of Cu, with unavoidable impurities, having an area ratio $S_B/S_s$ of 0.40 or more in an EBSD (electron backscatter diffractometry) measurement in a measurement region provided in a range of from a ¼ sheet thickness position to a ¾ sheet thickness position on a cross section extending in a sheet thickness direction perpendicular to a rolling direction, wherein $S_s$ represents an area of a region satisfying at least one of conditions of a crystal orientation difference from the S1 {241}<112>orientation of 10° or less or a crystal orientation difference from the S2 {231}<124>orientation of 10° or less, and $S_B$ represents an area of a region having a crystal orientation difference from the Brass {011}<211>orientation of 10° or less.

In the description herein, the "sheet material" means a metal material in the form of sheet. A metal material in the form of thin sheet may also be referred to as a "foil", and the "foil" is also encompassed in the "sheet material". A metal material in the form of sheet coiled in a coil form is also encompassed in the "sheet material". In the description herein, the thickness of a metal material in the form of sheet is referred to as a "sheet thickness".

In the aforementioned alloy elements, Co, Mg, Cr, P, B, Mn, Sn, Ti, Zr, Al, Fe, Zn, and Ag are optionally added elements. The "¼ sheet thickness position" means the position in the sheet thickness direction at a distance of t/4 (mm) from one of the rolled surfaces, wherein t (mm) represents the sheet thickness. Similarly, the "¾ sheet thickness position" means the position in the sheet thickness direction at a distance of 3t/4 (mm) from the aforementioned rolled surface.

The values $S_B$ and $S_S$ and the KAM (kernel average misorientation) value in the EBSD (electron backscatter diffractometry) can be obtained in the following manner.

[Method for Obtaining $S_s$ and $S_B$ by EBSD]

The cross section extending in a sheet thickness direction and perpendicular to the rolling direction of the sheet material (which is referred to as an "LD plane") is observed with an FE-SEM (field emission scanning electron microscope), and the measurement region having a rectangular shape of 24 μm in the sheet width direction and 18 μm in the sheet thickness direction provided in a range of from the ¼ sheet thickness position to the ¾ sheet thickness position is measured for the crystal orientation by the EBSD (electron backscatter diffractometry) at a step size (measurement pitch) of 0.05 μm. In the measurement region, the region having a crystal orientation difference from the S1 {241}<112>orientation of 10° or less (which is referred to as an "S1 region"), the region having a crystal orientation difference from the S2 {231}<124>orientation of 10° or less (which is referred to as an "S2 region"), and the region having a crystal orientation difference from the Brass {011}<211>orientation of 10° or less (which is referred to as a "Brass region") each are mapped with an EBSD data analysis software.

The value obtained by subtracting the overlapping area of the S1 region and the S2 region from the sum of the area of the S1 region and the area of the S2 region is designated as $S_s$. The $S_s$ corresponds to the "area of the region satisfying at least one of conditions of a crystal orientation difference from the S1 {241} <112>orientation of 10° or less or a crystal orientation difference from the S2 {231}<124>orientation of 10° or less".

The area of the Brass region is designated as $S_B$.

[Method for Obtaining KAM Value]

In the aforementioned EBSD measurement data measured at a step size (measurement pitch) of 0.05 μm on the LD plane, the KAM value inside the crystal grain is calculated assuming the boundary of an orientation difference of 15° or more as the crystal grain boundary. The KAM value corresponds to the value obtained in such a manner that as for the electron beam irradiation spots disposed at a pitch of 0.05 μm, all the crystal orientation differences between the adjacent spots (which each are hereinafter referred to as an "adjacent spot orientation difference") are measured, and the measured values of the adjacent spot n orientation difference of less than 15° are extracted and calculated for the average value thereof. Accordingly, the KAM value is an index showing the amount of the lattice strain inside the crystal grain, and a larger value thereof can be evaluated as a material having a larger strain of the crystal lattice. The step size herein is as minute as 0.05 μm, and thus the distribution of the dislocation density can be accurately comprehended.

[Method for Obtaining Average Crystal Grain Size]

In the aforementioned EBSD measurement data measured at a step size (measurement pitch) of 0.05 μm on the LD plane, a boundary (including a twin boundary) of an orientation difference of 15° or more is assumed as the crystal grain boundary, the crystal grain sizes of all the crystal grains existing in the measurement region are obtained by the diameter chart, and the average value of the crystal grain sizes is calculated by the area fraction method and designated as the average crystal grain size (μm). As for the crystal grain that protrudes by a part thereof from the edge of the measurement region, the area of the part of the crystal grain that exists inside the measurement region is used for the calculation of the average crystal grain size.

[Method for Obtaining Number Density of Fine Second Phase Particles]

A specimen collected from the sheet material to be measured is observed with a TEM (transmission electron microscope), and the number of the second phase particles having a particle diameter of 20 to 30 nm confirmed in each of the observation view fields is counted. Plural view fields that are randomly selected and do not overlap each other are used as the observation view fields. The diameter of the minimum circle surrounding the particle is designated as the particle diameter. A value (per $mm^2$) obtained by dividing the total count number of the second phase particles having a particle diameter of 20 to 30 nm by the total area of the observation view fields is designated as the number density of the fine second phase particles.

[Method for Obtaining Number Density of Coarse Second Phase Particles]

The sheet surface (rolled surface) is electropolished to dissolve only the Cu matrix, so as to prepare an observation surface having the second phase particles exposed thereon, the observation surface is observed with an SEM, and a value obtained by dividing the total number of the second phase particles having a major diameter of 2.0 μm or more observed on the SEM image by the total observation area ($mm^2$) is designated as the number density of the coarse second phase particles (per $mm^2$). The total observation area is 0.01 $mm^2$ or more in total of plural observation view fields that are randomly selected and do not overlap each other. As for the secondary phase particle that protrudes by a part thereof from the observation view field, the particle having a part existing inside the observation view field having a major diameter of 2.0 μm or more is counted.

The rolling reduction ratio from a thickness $t_0$ (mm) to a thickness $t_1$ (mm) is determined by the following expression (1).

$$\text{Rolling reduction ratio } (\%)=(t_0-t_1)/t_0\times 100 \quad (1)$$

Advantageous Effects of Invention

According to the present invention, a thin sheet material of a Cu—Ni—Si-based copper alloy that is excellent in "characteristics that the material is easily etched in the depth direction but is not easily etched in the width direction of the slit" can be provided. Accordingly, a current-carrying component having a high etching accuracy for applying to a semiconductor package having an extremely narrow pitch can be realized by using the Cu—Ni—Si-based copper alloy, which inherently has a good balance among the characteristics, such as the strength, the conductivity, and the bending workability.

BRIEF DESCRIPTION OF DRAWINGS

FIG. 1 is an illustration schematically showing a cross section of a copper alloy sheet material and a resist film formed on a rolled surface thereof, in the stage before an etching experiment.

FIG. 2 is an illustration schematically showing the cross section of the copper alloy sheet material and the resist film formed on the rolled surface thereof, in the stage after the etching experiment.

FIG. 3 is an illustration schematically showing the cross section of the copper alloy sheet material and the resist film formed on the rolled surface thereof, in the stage after the etching experiment, for the copper alloy sheet material having an improved etching factor as compared to the case shown in FIG. 2.

FIG. 4 is an example of an optical microscope image of an observation cross section after the etching experiment.

DESCRIPTION OF EMBODIMENTS

[Etching Factor]

In the description herein, an "etching factor" is introduced as an index of "characteristics that the material is easily etched in the depth direction but is not easily etched in the width direction of the slit". The etching factor of a copper alloy sheet material can be obtained by performing an experiment in which a slit pattern having a prescribed shape is formed on one rolled surface of a copper alloy sheet material specimen with a photoresist film, and the surface having the slit pattern formed thereon is etched under the prescribed condition. The concept of the etching factor will be described with reference to FIGS. 1 to 3.

FIG. 1 schematically shows the cross section of the copper alloy sheet material and the resist film formed on the rolled surface thereof, in the stage before the etching experiment. A part of a rolled e surface 10 of copper alloy sheet material 1 is masked with a resist film 2, and a slit 3 is formed at a position where the rolled surface 10 is exposed. The figure corresponds to the cross section perpendicular to the longitudinal direction of the slit. The thickness of the resist film is shown in exaggeration. W1 represents the aperture width of the resist film corresponding to the slit width. In the examples described later, a slit pattern having a length of 70 mm and a width W1 of 280 μm was formed in such a manner that the longitudinal direction of the slit was directed to the rolling direction.

FIG. 2 schematically shows the cross section of the copper alloy sheet material and the resist film formed on the rolled surface thereof, in the stage after the etching experiment. The etching is terminated before the erosion by etching penetrates through the sheet thickness. d represents the etching depth. The etching experiment is performed to form a groove having the prescribed etching depth by controlling the etching time under the same etching condition. In the examples described later, the etching experiment was performed under the condition providing the etching depth d of 60 μm. The etching proceeding from the part of the slit 3 not masked with the resist film 2 is terminated in the state where the corrosion proceeds to the etching depth d in the sheet thickness direction, but the corrosion also proceeds in the width direction of the slit associated with the progress of the etching, and consequently the groove width after the etching becomes larger than the aperture width W1 of the resist film. In the groove obtained by this etching experiment, in general, the distance between the walls of the groove measured in the width direction of the slit is the longest at the aperture part immediately beneath the resist film or in the vicinity thereof. The groove width after the etching represented by the longest wall distance is referred to as an "etching width", and is represented by a symbol W2 in the figures. The corrosion amount in the slit width direction is referred to as a "side etching length", and is represented by the symbol L. The side etching length L is defined by the following expression (2).

$$L=(W2-W1)/2 \quad (2)$$

wherein

L: side etching length (μm)

W1: aperture width of resist film (μm)

W2: etching width (μm)

In general, the erosion amounts in the slit width direction on both sides of the groove are substantially equivalent to each other, and therefore the side etching length L can be assumed as the erosion amount in the slit width direction per one edge of the groove. In the figures, the erosion amounts in the slit width direction on both sides of the slit 3 each are shown by L.

The side etching length L is increased according to the etching time, and therefore for evaluating the "characteristics that the material is easily etched in the depth direction but is not easily etched in the width direction of the slit", it is necessary to provide an index showing the relationship of the etching depth d and the side etching length L. The index is the etching factor. In the description herein, an etching factor Ef is defined by the following expression (3).

$$Ef=d/L \quad (3)$$

wherein

Ef: etching factor d: etching depth (μm)

L: side etching length (μm)

FIG. 3 schematically shows the cross section of the copper alloy sheet material and the resist film formed on the rolled surface thereof, in the stage after the etching experiment, for the copper alloy sheet material having an improved etching factor as compared to the case shown in FIG. 2. As compared to FIG. 2, the etching depth d is the same, but the side etching length L is shorter. Therefore, the etching factor Ef defined by the expression (3) is larger. In this case, at the time when the etching is performed until penetrating through the sheet thickness for forming a pin, the excessive erosion in the width direction of the pin is suppressed, and the etching work that is closer to the masking pattern of the photoresist film can be performed. In the case where precision etching with a small pin width is performed, in particular, the application of a material having a large etching factor Ef is significantly effective for achieving a high dimensional accuracy after the etching. The present invention can provide an effect of enhancing the etching factor Ef.

[Chemical Composition]

A Cu—Ni—Si-based copper alloy is applied to the present invention. In the following description, the "%" relating to the alloy components means "% by mass" unless otherwise indicated.

Ni forms a Ni—Si-based precipitate. In the case where Co is contained as an additive element, a Ni—Co—Si-based precipitate is formed therewith. These precipitates enhance the strength and the conductivity of the copper alloy sheet material. It is considered that the Ni—Si-based precipitate is a compound formed mainly of $Ni_2Si$, and the Ni—Co—Si-based precipitate is a compound formed mainly of $(Ni, Co)_2Si$. These compounds correspond to the "second phase" referred in the description herein. For sufficiently dispersing fine precipitate particles effective for enhancing the strength, the Ni content is necessarily 1.0% or more, and is more preferably 1.5% or more. In the case where Ni is excessive, on the other hand, a coarse precipitate tends to form, by which cracks readily occur in hot rolling. The Ni content is restricted to 4.5% or less, and may be managed to less than 4.0%.

Si forms a Ni—Si-based precipitate. In the case where Co is contained as an additive element, a Ni—Co—Si-based precipitate is formed therewith. For sufficiently dispersing fine precipitate particles effective for enhancing the strength, the Si content is necessarily 0.1% or more, and is more preferably 0.4% or more. In the case where Si is excessive, on the other hand, a coarse precipitate tends to form, by which cracks readily occur in hot rolling. The Si content is restricted to 1.4% or less, and may be managed to 1.2% or less, or to less than 1.0%.

Co forms a Ni—Co—Si-based precipitate to enhance the strength and the conductivity of the copper alloy sheet material, and therefore may be added depending on necessity. For sufficiently dispersing the fine precipitate effective for enhancing the strength, it is effective that the Co content is 0.5% or more. However, the increase of the Co content may lead the formation of a coarse precipitate, and therefore in the case where Co is added, the addition thereof is performed in a range of 2.0% or less. The content thereof may be managed to less than 1.5%.

As the additional elements, Mg, Cr, F, B, Mn, Sn, Ti, Zr, Al, Fe, Zn, Ag, Be, and the like may be contained depending on necessity. The content ranges of these elements are preferably Mg: 0 to 0.50%, Cr: 0 to 0.50%, P: 0 to 0.20%, B: 0 to 0.20%, Mn: 0 to 1.00%, Sn: 0 to 1.00%, Ti: 0 to 0.50%, Zr: 0 to 0.30%, Al: 0 to 1.00%, Fe: 0 to 1.00%, Zn: 0 to 1.00%, Ag: 0 to 0.30%, and Be: 0 to 0.15%.

In particular, the content ranges of Mg, Cr, P, B, Mn, Zr, Al, and Fe may be restricted to Mg: 0 to 0.30%, Cr: 0 to 0.20%, P: 0 to 0.10%, B: 0 to 0.05%, Mn: 0 to 0.20%, Zr: 0 to 0.20%, Al: 0 to 0.20%, Fe: 0 to 0.30%, and Ag: 0 to 0.20%.

Cr, P, B, Mn, Ti, Zr, and Al have a function of further enhancing the strength of the alloy and of decreasing the stress relaxation. Sn, Mg, and Ag are effective for enhancing the stress relaxation resistance characteristics. Zn improves the solderability and the casting capability of the copper alloy sheet material. Fe, Cr, Zr, Ti, and Mn readily form a high melting point compound with S, Pb, and the like existing as the unavoidable impurities, and B, P, Zr, and Ti have an effect of making a fine cast structure, and can contribute to the improvement of the hot workability.

In the case where one kind or two or more kinds of Mg, Cr, P, B, Mn, Sn, Ti, Zr, Al, Fe, Zn, and Ag are contained, it is more effective that the total content thereof is 0.01% or more. However, a large amount thereof contained adversely affects the hot or cold workability and is also disadvantageous in cost. The total amount of these optionally added elements is more desirably 1.0% or less, and further 0.5% or less.

[Crystal Orientation]

In the present invention, the crystal orientation that exhibits an effect of enhancing the aforementioned etching factor is identified. The etching factor is a parameter that reflects the anisotropy of erosion inside the sheet. Therefore, the distribution of crystal orientations on the cross section in parallel to the sheet thickness direction is important for improving the etching factor. The present inventors have researched the distribution of crystal orientations on the cross section in parallel to the sheet thickness direction, and have investigated the relationship to the etching factor in detail. As a result, it has been found that the crystal orientation having an area ratio $S_B/S_s$ of 0.40 or more in the EBSD (electron backscatter therebetween) measurement in a measurement region provided in a range of from the ¼ sheet thickness position to the ¾ sheet thickness position is significantly effective, wherein $S_s$ represents the area of the region satisfying at least one of conditions of a crystal orientation difference from the S1 {241}<112>orientation of 10° or less or a crystal orientation difference from the S2 {231}<124>orientation of 10° or less, and $S_B$ represents the area of a region having a crystal orientation difference from the Brass {011}<211>orientation of 10° or less. $S_B$ and $S_s$ can be determined according to the "Method for obtaining $S_s$ and $S_B$ by EBSD" described above.

As for a thin sheet material of a Cu—Ni—Si-based copper alloy, it has been stated that a crystal orientation having the Brass orientation as a dominant orientation is advantageous for enhancing the press punching capability and the smoothness of the etched surface. However, only this cannot be measures for improving the etching factor. The enhancement of the etching factor can be achieved by the area ratio $S_R/S_S$ of 0.40 or more on the LD plane including the sheet thickness direction. The area ratio $S_B/S_S$ is more preferably 0.50 or more, further preferably 0.65 or more, and still further preferably 0.70 or more. The upper limit of $S_B/S_S$ may not be particularly determined, and it suffices that the upper limit is regulated, for example, to a range of 0.95 or less.

[KAM Value]

For obtaining a high etching factor, it has been found that a large KAM value based on the precise EBSD measurement data with a small step size of 0.05 μm is also advantageous. Specifically, it is effective that KAM value is 2.00° or more measured at a step size of 0.05 μm inside a crystal grain assuming a boundary of a crystal orientation difference of 15° or more as a crystal grain boundary. The KAM value is a parameter that has a correlation to the dislocation density inside the crystal grain. It is considered that a large KAM value means that the average dislocation density inside the crystal grain is large. As for the etching, in general, it is considered that a part having a high dislocation density is preferentially etched (eroded). It is considered that a large KAM value with a small step size of 0.05 μm means a metal structure state having an extremely small amount of regions where the dislocation density is locally small. It is estimated that this is a contributing factor providing a high etching factor. The KAM value with a small step size of 0.05 μm can be obtained according to the "Method for obtaining KAM Value" described above. The KAM value is more preferably 2.20° or more, and further preferably 2.40° or more. The upper limit of the KAM value may not be particularly determined, and it suffices that the upper limit is regulated, for example, to a range of 3.00° or less. The influence of the KAM value on the etching factor cannot be sufficiently comprehended by an ordinary EBSD measurement data with a large step size, for example, of 0.2 μm or more.

[Average Crystal Grain Size]

A small average crystal grain size is also advantageous for providing a high etching factor. An average crystal grain size by the area fraction method assuming a boundary (including a twin boundary) of a crystal orientation difference of 15° or more in the EBSD measurement on the LD plane as the crystal grain boundary can be used herein. For example, the EBSD measurement data according to the "Method for obtaining $S_S$ and $S_B$ by EBSD" described above may be used. In this case, as for a crystal grain that protrudes by a part thereof from the edge of the measurement region, the area of the part thereof that exists inside the measurement region may be used for the calculation of the average crystal grain size with no problem. The average crystal grain size by the area fraction method is preferably 2.00 μm or less, more preferably 1.80 μm or less, and further preferably 1.50 μm or less. The lower limit of the average crystal grain size may not be particularly determined, and it suffices that the lower limit is regulated, for example, to a range of 0.60 μm or more.

[Fine Second Phase Particles]

In a copper alloy, in general, it is considered that fine precipitate having a particle diameter of 2 to 30 nm contributes to the enhancement of the strength. According to the investigation by the present inventors, it has been found that as for a Cu—Ni—Si-based copper alloy as the target in the present invention, a sufficient amount secured particularly for the precipitate having a particle diameter of 20 to 30 nm in the aforementioned fine precipitate is also effective for the improvement of the etching factor. As a result of the various investigations, for stably providing a particularly excellent etching factor, it is advantageous that the number density of the fine second phase particles having a particle diameter of 20 to 30 nm is $1.0\times10^7$ per $mm^2$ or more, and may be $3.0\times10^7$ per $mm^2$ or more. The upper limit of the number density of the fine second phase particles may not be particularly determined since it is restricted by defining the contents of Ni, Si, and Co as described above, and is generally in a range of $10.0\times10^7$ per $mm^2$ or less.

[Coarse Second Phase Particles]

Coarse particles in the second phase particles do not contribute to the reinforcement, and may be a contributing factor of the deterioration of the bending workability and the occurrence of smut. As a result of various investigations, in the case where the bending workability and the suppression of occurrence of smut are important, it is advantageous to provide a metal structure state having a number density of coarse second phase particles having a particle diameter of 0.5 μm or more of $5.0\times10^5$ per $mm^2$ or less.

[Tensile Strength and Conductivity]

The material for a current-carrying component produced through precise etching of a thin sheet material is demanded to have a strength level with a tensile strength in the rolling direction of 600 MPa or more and a conductivity of 28% IACS or more. With the aforementioned chemical composition satisfied, a sheet material having a tensile strength of 600 MPa or more and a conductivity of 28% IACS or more can be obtained by the production method described later. The tensile strength may also be controlled to a strength level of 750 MPa or more, 800 MPa or more, 900 MPa or more, and further 1,000 MPa or more. The conductivity may also be controlled to 30% IACS or more, 35% IACS or more, 40% IACS or more, and further 50% IACS or more.

[Production Method]

The copper alloy sheet material described above can be produced, for example, by the following production steps.

Melting and casting⇒hot rolling⇒cold rolling⇒(intermediate annealing⇒cold rolling)⇒solution treatment⇒intermediate cold rolling⇒aging treatment⇒finish cold rolling⇒pass through tension leveler⇒low temperature annealing While not shown in the above steps, facing is performed depending on necessity after the hot rolling, and pickling, polishing, and if any, degreasing are performed after each of the heat treatments. The steps will be described below.

[Melting and Casting]

A cast slab may be produced through continuous casting, semi-continuous casting, or the like. For preventing oxidation of Si and the like, the step is preferably performed in an inert gas atmosphere or in a vacuum melting furnace.

[Hot Rolling]

The hot rolling may be performed according to the ordinary method. The heating of the cast slab before the hot rolling may be performed, for example, at 900 to 1,000° C. retaining for 1 to 5 hours. The total hot rolling reduction ratio may be 70 to 97%. The rolling temperature of the last pass is preferably 700° C. or more. After completing the hot rolling, quenching is preferably performed by water cooling or the like.

[Cold Rolling]

The cold rolling may be performed according to the ordinary method, so as to provide an intermediate product sheet material to be subjected to the solution treatment as the subsequent step. The intermediate annealing and the cold rolling may be performed once or multiple times for controlling the sheet thickness depending on necessity, so as to provide an intermediate product sheet material.

[Solution Treatment]

The solution treatment is preferably performed under condition at 780 to 1,060° C. retaining for 10 to 80 seconds. In the case where the heating temperature is too low, or the retention time is too short, the solutioning may be insufficient to fail to provide a satisfactory high strength finally. In the case where the heating temperature is too high, or the retention time is too long, the area ratio of the Brass orientation tends to be low finally, and it may be difficult to control the area ratio $S_B/S_S$ to the prescribed value or more. The cooling rate may be quenching to such an extent that can be achieved by the ordinary continuous annealing line. For example, the average cooling rate from 530° C. to 300° C. is preferably 100° C./s or more.

[Intermediate Cold Rolling]

The cold rolling is performed before the aging treatment, so as to reduce the sheet thickness and to introduce strain energy (dislocations). In the description herein, the cold rolling in this stage is referred to as "intermediate cold rolling". The aging treatment applied to the sheet material in a state where strain energy is introduced thereto is effective for enhancing the etching factor of the final product. For sufficiently exhibiting the effect, the rolling reduction ratio in the intermediate cold rolling is preferably 50% or more, and may be managed to 60% or more. However, in the case where the sheet thickness is excessively reduced in this stage, the rolling reduction ratio necessary in the finish cold rolling described later may be difficult to secure in some cases. Accordingly, the rolling reduction ratio in the intermediate cold rolling is preferably set, for example, to a range of 95% or less corresponding to the final sheet thickness.

[Aging Treatment]

The aging treatment is then performed, so as to precipitate the fine second phase particles, which contribute to the strength and are effective for enhancing the etching factor. The aging treatment condition may be set corresponding to the demand characteristics within a condition range of an aging temperature of 430 to 550° C. and a retention time of 3 to 10 hours at the temperature range. However, in the case where recrystallization occurs, it may be difficult to provide the crystal orientation having a high $S_B/S_S$ ratio, and therefore it is necessary to perform the aging treatment under the condition that causes no recrystallization within the temperature range and the range of the retention time shown above.

[Finish Cold Rolling]

In the description herein, the final cold rolling performed after the aging treatment is referred to as "finish cold rolling". For achieving the crystal orientation having a high $S_B/S_S$ ratio described above, it is important to secure sufficiently the total cold rolling reduction ratio applied after the step in which recrystallization finally occurs. In the production method described in the description herein, the final heat treatment that is performed under condition causing recrystallization is the solution treatment. Therefore, the finally necessary cold rolling reduction ratio is achieved by the intermediate cold rolling and the finish cold rolling. The present inventors have performed many laboratory experiments for investigating the relationship among each of the rolling reduction ratios in the intermediate cold rolling and the finish cold rolling, the total cold rolling reduction ratio thereof, and the finally resulting crystal orientation. As a result, it has been found that in the case where the rolling reduction ratio in the intermediate cold rolling is 60% or more, and the rolling reduction ratio in the finish cold rolling performed after the aging treatment is 18% or more, the finally demanded crystal orientation can be obtained by making the total cold rolling reduction ratio thereof of 90% or more. In addition, it has also been found that in the case where the rolling reduction ratio in the intermediate cold rolling is 50% or more, and the rolling reduction ratio in the finish cold rolling performed after the aging treatment is 25% or more, the lower limit of the total cold rolling reduction ratio necessary therein can be relaxed to 75%. The mechanism thereof is not still unclear, but is considered that the contribution of the introduced cold rolling strain on the texture may slightly differ before and after the aging treatment. The rolling reduction ratio in the finish cold rolling is preferably 85% or less since a too large rolling reduction ratio in the finish cold rolling may lower the strength in the low temperature annealing. The final sheet thickness may be set, for example, to a range of 0.04 to 0.30 mm, and may also be managed to a range of 0.06 to 0.30 mm.

In summary, the finish cold rolling may be performed under a condition satisfying at least one of the following cold rolling conditions A or B.

(Cold rolling condition A)

$R_1 \geq 50\%$, $R_2 \geq 25\%$, and $R_T \geq 75\%$ (Cold rolling condition B)

$R_1 \geq 60\%$, $R_2 \geq 18\%$, and $R_T \geq 90\%$

Herein, $R_1$ (%) represents the rolling reduction ratio in the intermediate cold rolling, $R_2$ (%) represents the rolling reduction ratio in the finish cold rolling, and $R_T$ (%) represents the total rolling reduction ratio in the intermediate cold rolling and the finish cold rolling.

The rolling reduction ratio is determined by the expression (1) described above.

For example, in the case where the sheet thickness after the solution treatment is 0.45 mm, the sheet thickness after the intermediate rolling is 0.15 mm, and the sheet thickness after the finish cold rolling is 0.08 mm, the cold rolling condition A is satisfied as follows.

Rolling reduction ratio $R_1$ in intermediate cold rolling=(0.45−0.15)/0.45×100≈66.7%

Rolling reduction ratio $R_2$ in finish cold rolling=(0.15−0.08)/0.15×100≈46.7%

Total rolling reduction ratio $R_T$=(0.45−0.08)/0.45×100≈82.2%

[Pass Through Tension Leveler]

The present inventors have found that for achieving the crystal orientation having a high $S_B/S_S$ ratio described above, it is significantly effective that a relatively large deformation is applied to the sheet material after completing the finish cold rolling, with a tension leveler, before performing the final low temperature annealing. The tension leveler is a machine that bends and stretches a sheet material with plural rolls under application of tension in the rolling direction. The tension leveler is generally used for correcting a shape failure of a sheet caused by cold rolling or the like, and the deformation amount applied thereon is frequently in a range of 0.1 to 1.5% in terms of elongation ratio. In the case where a thin sheet material of a Cu—Ni—Si-based copper alloy is passed through a tension leveler at an elongation ratio exceeding 1.5%, the effect of shape correction is not stabilized, and therefore the shape correction with a larger elongation ratio than that value is generally not performed. However, it has been found that the application of a deformation with an elongation ratio exceeding 1.5% in the stage before the low temperature annealing can provide the crystal orientation having a high $S_B/S_S$ ratio. Furthermore, it has been confirmed that even though the sheet material is passed through a tension leveler at a large elongation ratio exceeding 1.5%, a good sheet shape can be sufficiently obtained since the shape of the sheet material finally obtained (particularly the flatness) depends on the combination of the condition in the finish cold rolling, the condition in passing through the tension leveler, and the condition in the low temperature annealing. The experiments have been repeated for the elongation ratio applied with the tension leveler of up to approximately 3.7% currently, and a good effect can be obtained. Accordingly, in the present invention, the elongation ratio in the pass through a tension leveler is determined to a range of more than 1.5% and 3.7% or less.

[Low Temperature Annealing]

The cold rolled material of the Cu—Ni—Si-based copper alloy having been subjected to the finish cold rolling is generally subjected to the low temperature annealing for such final purposes as the reduction of the residual stress, the enhancement of the bending workability, and the enhancement of the stress relaxation resistance through the reduction of voids and dislocations on the slip plane. The low temperature annealing of copper alloys has been performed in a mixed atmosphere of hydrogen and an inert gas having a hydrogen concentration of 15% by volume or more for preventing oxidation. The low temperature annealing is performed also in the present invention. However, it has been found that for stably achieving the crystal orientation having a high $S_B/S_S$ ratio, it is necessary that the atmosphere in the low temperature annealing is necessarily an atmosphere having a low hydrogen concentration. The mechanism therefor is still unclear. Specifically, a good result can be obtained by performing the low temperature annealing in a mixed gas atmosphere of hydrogen gas and an inert gas having a hydrogen concentration of 3 to 13% by volume under a condition of retaining at 380 to 550° C. for 10 to 620 seconds.

Examples

Copper alloys having the chemical compositions shown in Table 1 were melted and casted with a vertical semi-continuous casting machine. The resulting cast slabs each were heated to 1,000° C. for 3 hours, then extracted, and subjected to hot rolling to a thickness of 14 mm, followed by cooling with water. The total hot rolling reduction ratio was 90 to 95%. After the hot rolling, the oxide layer as the surface layer was removed (faced) through mechanical polishing, and the material was subjected to cold rolling to provide an intermediate product sheet material to be subjected to the solution treatment. The intermediate product sheet materials each were subjected to the solution treatment, the intermediate cold rolling, the aging treatment, the finish cold rolling, the pass through a tension leveler, and the low temperature annealing under the conditions shown in Table 2, so as to provide a sheet material product (test material) having a sheet thickness of 0.08 mm. In a part of the comparative examples (No. 31), the sheet material having been subjected to the hot rolling and then facing was subjected to cold rolling of 90% to provide an intermediate product sheet material, which was then subjected to the solution treatment, and the intermediate cold rolling was omitted. The low temperature annealing was performed with a continuous annealing furnace capable of controlling the atmosphere inside the furnace. The atmosphere gas in the low temperature annealing was a mixed gas of hydrogen and nitrogen. Table 2 shows the hydrogen concentrations (% by volume) in the low temperature annealing atmospheres, and the balance is nitrogen.

The test materials each were subjected to the following investigations.

[$S_B/S_s$ Ratio based on Crystal orientation Data]

The cross section extending in a sheet thickness direction and perpendicular to the rolling direction (LD plane) of the specimen collected from the test material was treated with a cross section polisher (IB-19530CP, produced by JEOL, Ltd.) at an acceleration voltage of 4 kV, so as to produce a specimen surface for the EBSD measurement. The specimen surface was observed with FE-SEM (JSM-7200F, produced by JEOL, Ltd.) under condition of an acceleration voltage of 15 kV and a magnification of 5,000, and measured for the crystal orientation at a step size of 0.05 μm by the EBSD (electron backscatter diffractometry) according to the "Method for obtaining $S_s$ and $S_B$ by EBSD" described above with an EBSD device (Symmetry, produced by Oxford Instruments Ltd.) installed in the FE-SEM. Based on the resulting crystal orientation data, the area $S_s$ of the region satisfying at least one of conditions of a crystal orientation difference from the S1 {241}<112>orientation of 10° or less or a crystal orientation difference from the S2 {231}<124>orientation of 10° or less, and the area $S_B$ having a crystal orientation difference from the Brass {011}<211>orientation of 10° or less were obtained. Three specimens for LD plane observation were prepared per one test material, and the view field randomly selected within a range of from the ¼ sheet thickness position to the ¾ sheet thickness position of each of the LD planes was measured for $S_s$ and $S_B$, from which the area ratio $S_B/S_s$ was calculated, and the arithmetic average of the $S_B/S_s$ values of the three specimens was designated as the $S_B/S_s$ ratio of the test material. The EBSD data analysis software used was OIM-Analysis 7.3.1, produced by TSL Solutions K.K.

[KAM Value]

Based on the crystal orientation data of the EBSD measurement (measured at a step size of 0.05 μm) of the LD plane, the KAM value was obtained according to the "Method for obtaining KAM Value" described above. The arithmetic average of the KAM values of three specimens was designated as the KAM value of the test material.

[Average Crystal Grain Size]

Based on the crystal orientation data of the EBSD measurement (measured at a step size of 0.05 μm) of the LD plane, the average crystal grain size was obtained according to the "Method for obtaining Average Crystal Grain Size" described above. The arithmetic average of the values of the crystal grain size of three specimens was designated as the average crystal grain size of the test material.

The cleanup process was performed only once by the grain dilation method at a deviation angle of 5° and a minimum crystal grain size of 2 pixels.

[Number Density of Fine Second Phase Particles]

The number density of the fine second phase particles was obtained according to the "Method for obtaining Number Density of Fine Second Phase Particles" described above. Specifically, a circular plate having a diameter of 3 mm was punched out from the test material and subjected to a twin jet polishing method to prepare a TEM observation specimen, on which 10 view fields randomly selected were imaged with a TEM (EM-2010, produced by JEOL, Ltd.) at an acceleration voltage of 200 kV and a magnification of 100,000, and the number of the fine second phase particles having a particle diameter of 20 to 30 nm was counted on the images. The size of one view field was 770 nm×550 nm. The diameter of the minimum circle surrounding the particle was designated as the particle diameter.

[Number Density of Coarse Second Phase Particles]

The number density of the coarse second phase particles was obtained according to the "Method for obtaining Number Density of Coarse Second Phase Particles" described above. The electropolishing solution used for preparing an observation surface was a liquid obtained by mixing distilled water, phosphoric acid, ethanol, and 2-propanol at a ratio 2/1/1/1. The electropolishing was performed with an electropolishing device (Electropolisher Power Supply and Electropolisher Cell Module, produced by Buehler International Inc.) under condition of a voltage of 15 V and a time of 20 seconds.

[Tensile Strength]

A tensile test piece (JIS No. 5) in the rolling direction (LD) was collected from each of the test materials, and measured for the tensile strength by subjecting to a tensile test with a number of test specimens of 3 according to JIS 22241. The average value of the three specimens was designated as the score of the test material.

[Conductivity]

The conductivity of each of the test materials was measured with a double bridge device by the average cross sectional area method according to JIS H0505.

[Etching Factor]

On the rolled surface of a sheet material specimen collected from the test material having a sheet thickness of 0.08 mm (80 μm), a resist film of 70 mm in the rolling direction and 280 μm in the direction perpendicular to the rolling direction having a slit (i.e., a portion that was not masked with the resist film) is formed by a photoresist method. An aqueous solution of ferric chloride of 42 Baume was prepared as the etching solution. The copper alloy sheet material was etched from the slit portion by a method of spraying the etching solution at 50° C. uniformly on the slit, so as to form a groove having an etching depth d (see FIG. 2) of approximately 60 to 70 μm. The etching time was approximately 150 seconds. The specimen after etching was embedded in a resin, and a cross section perpendicular to the longitudinal direction of the slit was produced, on which the etching depth d and the etching width W2 (see FIG. 2) were measured with a laser microscope (OLS-4000, produced by Olympus Corporation). The side etching length L was calculated from these values according to the following expression (2), and the etching factor Ef was obtained according to the expression (3).

$$L=(W2-W1)/2 \quad (2)$$

$$Ef=d/L \quad (3)$$

Herein, W1 represents the aperture width of the resist film, and 280 μm is substituted thereto.

The observation of the cross section was performed for 10 view fields, and in the etching factors Ef obtained for the view fields, the arithmetic average value of 8 values except for the maximum value and the minimum value was obtained and designated as the etching factor of the test material.

For reference, FIG. 4 shows an example of the optical microscope image of the observation cross section after the etching experiment (imaged with the laser microscope). This is the example No. 3. The part shown by the symbol 101 is the sheet material specimen (test specimen). In this example, the etching depth d was 67.8 μm, and the etching width W2 was 290.1 μm, resulting in an etching factor Ef of 13.4.

Under the experiment condition, a specimen that has an etching factor of 10.0 or more is judged to have an improvement effect for the etching factor as compared to the ordinary Cu—Ni—Si-based copper alloy sheet material. The specimens having an etching factor of 10.0 or more were further classified and evaluated for the etching factor by the following five grades.

E: less than 10.0 (ordinary level)

D: 10.0 or more and less than 11.0

C: 11.0 or more and less than 12.0

B: 12.0 or more and less than 13.0

A: 13.0 or more

The grades C or higher having a higher improvement effect than the ordinary material were judged to have passed the test. It is evaluated that the "characteristics that the material is easily etched in the depth direction but is not easily etched in the width direction of the slit" is increased in the order D<C<B<A.

The results are shown in Table 3.

TABLE 1

| | | Chemical composition (% by mass) | | | | |
|---|---|---|---|---|---|---|
| Class | No. | Cu | Ni | Si | Co | Others |
| Invention Example | 1 | balance | 3.71 | 0.93 | — | Mg: 0.15 |
| | 2 | balance | 2.32 | 0.53 | — | |
| | 3 | balance | 2.51 | 0.91 | 1.26 | Zn: 0.004, Sn: 0.02 |
| | 4 | balance | 2.46 | 0.55 | — | Fe: 0.21 |
| | 5 | balance | 2.53 | 0.59 | — | Ti: 0.03, Al: 0.14 |
| | 6 | balance | 1.96 | 0.83 | 1.38 | Zr: 0.11, P: 0.02 |
| | 7 | balance | 2.27 | 0.87 | 1.29 | |
| | 8 | balance | 2.84 | 0.67 | — | B: 0.006, Fe: 0.15 |
| | 9 | balance | 1.80 | 0.85 | 1.71 | Ag: 0.03, Mn: 0.13 |
| | 10 | balance | 3.11 | 0.86 | — | Cr: 0.10 |
| | 11 | balance | 1.96 | 0.74 | 0.70 | Sn: 0.35, Ti: 0.14 |
| | 12 | balance | 1.57 | 0.84 | 1.85 | Zn: 0.16 |
| | 13 | balance | 2.32 | 0.44 | — | Cr: 0.001 |
| | 14 | balance | 2.56 | 0.61 | — | — |
| | 15 | balance | 2.40 | 0.55 | — | — |
| | 16 | balance | 2.42 | 0.92 | 1.31 | — |
| | 17 | balance | 4.20 | 1.30 | 1.15 | Be: 0.08 |
| Comparative Example | 31 | balance | 2.43 | 0.87 | 1.33 | — |
| | 32 | balance | 2.35 | 0.86 | 1.25 | Fe: 0.28 |
| | 33 | balance | 2.56 | 0.62 | — | Mg: 0.15 |
| | 34 | balance | 2.31 | 0.51 | — | Sn: 0.21, Zn: 0.70 |
| | 35 | balance | 2.55 | 0.86 | 1.00 | Mg: 0.05 |
| | 36 | balance | 2.20 | 0.75 | 0.95 | — |
| | 37 | balance | 2.33 | 0.48 | — | — |
| | 38 | balance | 2.41 | 0.50 | — | — |
| | 39 | balance | 2.35 | 0.58 | — | — |
| | 40 | balance | 2.50 | 0.49 | — | Mg: 0.05 |
| | 41 | balance | 0.48 | 0.09 | — | — |
| | 42 | balance | 5.00 | 1.06 | — | — |
| | 43 | balance | 3.64 | 0.76 | — | — |

TABLE 2

| | | Solution treatment | | Intermediate cold rolling Rolling | Aging treatment | | Finish cold rolling Rolling | Intermediate and finish total rolling | Tension leveler | Low temperature annealing | | |
|---|---|---|---|---|---|---|---|---|---|---|---|---|
| Class | No. | Temperature (° C.) | Time (s) | reduction ratio (%) | Temperature (° C.) | Time (h) | reduction ratio (%) | reduction ratio (%) | Elongation ratio (%) | Hydrogen concentration (% by volume) | Temperature (° C.) | Time (s) |
| Invention Example | 1 | 1000 | 20 | 71 | 450 | 6 | 38 | 82.0 | 3.3 | 10 | 450 | 30 |
| | 2 | 960 | 60 | 60 | 470 | 6 | 83 | 93.2 | 3.3 | 10 | 450 | 40 |
| | 3 | 1000 | 40 | 71 | 430 | 5 | 38 | 82.0 | 2.3 | 5 | 450 | 40 |
| | 4 | 960 | 30 | 60 | 465 | 6 | 83 | 93.2 | 1.8 | 10 | 425 | 85 |

TABLE 2-continued

| Class | No. | Solution treatment Temperature (° C.) | Solution treatment Time (s) | Intermediate cold rolling Rolling reduction ratio (%) | Aging treatment Temperature (° C.) | Aging treatment Time (h) | Finish cold rolling Rolling reduction ratio (%) | Intermediate and finish total rolling reduction ratio (%) | Tension leveler Elongation ratio (%) | Low temperature annealing Hydrogen concentration (% by volume) | Low temperature annealing Temperature (° C.) | Low temperature annealing Time (s) |
|---|---|---|---|---|---|---|---|---|---|---|---|---|
| | 5 | 965 | 40 | 92 | 450 | 3 | 20 | 93.6 | 2.6 | 10 | 450 | 40 |
| | 6 | 1040 | 20 | 76 | 500 | 6 | 28 | 82.7 | 3.0 | 10 | 475 | 60 |
| | 7 | 1000 | 20 | 56 | 480 | 5 | 60 | 82.4 | 2.7 | 5 | 450 | 150 |
| | 8 | 900 | 30 | 60 | 480 | 10 | 83 | 93.2 | 3.3 | 10 | 450 | 40 |
| | 9 | 960 | 60 | 56 | 480 | 9 | 60 | 82.4 | 2.1 | 10 | 480 | 40 |
| | 10 | 900 | 30 | 60 | 545 | 6 | 83 | 93.2 | 2.4 | 10 | 450 | 60 |
| | 11 | 1040 | 30 | 76 | 470 | 6 | 28 | 82.7 | 3.1 | 5 | 475 | 40 |
| | 12 | 1040 | 20 | 56 | 460 | 6 | 60 | 82.4 | 3.5 | 10 | 410 | 60 |
| | 13 | 960 | 30 | 60 | 450 | 5 | 83 | 93.2 | 2.9 | 5 | 450 | 350 |
| | 14 | 800 | 15 | 83 | 520 | 9 | 60 | 93.2 | 1.6 | 10 | 500 | 100 |
| | 15 | 1000 | 30 | 60 | 430 | 6 | 83 | 93.2 | 3.3 | 10 | 495 | 600 |
| | 16 | 1000 | 40 | 71 | 430 | 5 | 38 | 82.0 | 2.5 | 10 | 450 | 40 |
| | 17 | 1050 | 20 | 76 | 470 | 6 | 28 | 82.7 | 2.8 | 10 | 475 | 60 |
| Comparative Example | 31 | 1000 | 20 | — | 450 | 6 | 55 | 55.0 | 2.3 | 10 | 480 | 40 |
| | 32 | 1000 | 20 | 79 | 490 | 6 | 16 | 82.4 | 3.2 | 10 | 480 | 40 |
| | 33 | 1100 | 20 | 60 | 450 | 6 | 83 | 93.2 | 1.9 | 5 | 450 | 40 |
| | 34 | 960 | 120 | 60 | 450 | 6 | 83 | 93.2 | 2.3 | 10 | 450 | 40 |
| | 35 | 1000 | 20 | 71 | 650 | 20 | 38 | 82.0 | 3.5 | 10 | 475 | 40 |
| | 36 | 1000 | 20 | 71 | 460 | 6 | 38 | 82.0 | 0.1 | 5 | 480 | 40 |
| | 37 | 960 | 60 | 60 | 460 | 6 | 83 | 93.2 | 1.1 | 10 | 450 | 40 |
| | 38 | 960 | 60 | 60 | 460 | 6 | 83 | 93.2 | 2.2 | 10 | 600 | 40 |
| | 39 | 960 | 60 | 60 | 460 | 6 | 83 | 93.2 | 3.5 | 10 | 450 | 650 |
| | 40 | 960 | 60 | 60 | 460 | 6 | 83 | 93.2 | 2.8 | 40 | 450 | 40 |
| | 41 | 960 | 60 | 60 | 490 | 6 | 83 | 93.2 | 1.6 | 10 | 450 | 40 |
| | 42 | 960 | 60 | 60 | 460 | 6 | 83 | 93.2 | 2.5 | 5 | 450 | 40 |
| | 43 | 960 | 60 | 79 | 460 | 6 | 16 | 82.4 | 1.8 | 10 | 450 | 40 |

TABLE 3

| Class | No. | Crystal orientation $S_B/S_S$ ratio | KAM value (°) | Average crystal grain size (μm) | Number density of coarse second phase particles ($\times 10^5$/mm$^2$) | Number density of fine second phase particles ($\times 10^7$/mm$^2$) | Tensile strength (MPa) | Conductivity (% IACS) | Evaluation of etching factor |
|---|---|---|---|---|---|---|---|---|---|
| Invention Example | 1 | 0.78 | 2.25 | 1.23 | 1.9 | 4.8 | 1006 | 39 | A |
| | 2 | 0.92 | 2.46 | 0.92 | 6.2 | 6.3 | 882 | 44 | A |
| | 3 | 0.76 | 2.12 | 1.26 | 2.3 | 5.2 | 1023 | 38 | A |
| | 4 | 0.65 | 2.21 | 0.89 | 1.1 | 7.1 | 864 | 43 | B |
| | 5 | 0.62 | 2.03 | 1.35 | 2.6 | 0.8 | 827 | 45 | C |
| | 6 | 0.66 | 2.01 | 1.68 | 1.5 | 5.2 | 1045 | 37 | B |
| | 7 | 0.60 | 2.36 | 1.29 | 2.8 | 5.0 | 958 | 37 | B |
| | 8 | 0.88 | 2.65 | 0.82 | 2.5 | 4.4 | 809 | 48 | A |
| | 9 | 0.79 | 2.47 | 1.33 | 1.4 | 5.8 | 951 | 42 | A |
| | 10 | 0.91 | 2.53 | 1.02 | 3.6 | 6.9 | 783 | 50 | A |
| | 11 | 0.68 | 2.16 | 1.49 | 1.8 | 2.5 | 956 | 36 | B |
| | 12 | 0.77 | 2.40 | 1.54 | 3.2 | 3.5 | 1013 | 42 | A |
| | 13 | 0.82 | 2.55 | 1.67 | 2.4 | 3.2 | 811 | 53 | A |
| | 14 | 0.51 | 2.01 | 2.08 | 8.2 | 1.3 | 692 | 52 | C |
| | 15 | 0.68 | 1.92 | 1.92 | 1.5 | 2.5 | 832 | 47 | C |
| | 16 | 0.78 | 2.20 | 1.30 | 2.5 | 5.0 | 1025 | 38 | A |
| | 17 | 0.61 | 2.03 | 1.52 | 1.2 | 5.5 | 1120 | 30 | B |
| Comparative Example | 31 | 0.19 | 1.75 | 3.20 | 1.8 | 5.6 | 1019 | 39 | E |
| | 32 | 0.27 | 1.82 | 2.75 | 2.1 | 5.7 | 982 | 39 | E |
| | 33 | 0.24 | 1.65 | 2.68 | 2.8 | 4.5 | 896 | 42 | E |
| | 34 | 0.21 | 1.90 | 2.24 | 2.6 | 3.1 | 871 | 47 | E |
| | 35 | 0.26 | 1.86 | 2.06 | 2.4 | 4.9 | 995 | 40 | E |
| | 36 | 0.17 | 1.96 | 1.97 | 3.5 | 5.8 | 1024 | 40 | E |
| | 37 | 0.27 | 1.91 | 1.98 | 3.4 | 3.5 | 857 | 52 | E |
| | 38 | 0.25 | 1.82 | 2.51 | 2.4 | 4.6 | 824 | 47 | E |
| | 39 | 0.28 | 1.91 | 2.35 | 1.7 | 3.2 | 819 | 45 | E |
| | 40 | 0.21 | 1.78 | 2.54 | 2.2 | 5.8 | 865 | 53 | E |
| | 41 | 0.26 | 1.65 | 2.56 | 10.7 | 1.8 | 702 | 50 | E |
| | 42 | 0.18 | 1.56 | 1.93 | 2.5 | 0.3 | 865 | 45 | E |
| | 43 | 0.23 | 1.81 | 2.57 | 2.3 | 5.4 | 956 | 38 | E |

The examples of the present invention having the chemical compositions and the production conditions that were strictly controlled according to the aforementioned determination each had a crystal orientation with a high $S_B/S_S$ ratio and were confirmed to exhibit an excellent improvement effect for the etching factor. In particular, the examples having a KAM value of the LD plane of 2.00° or more measured at a step size of 0.05 μm, an average crystal grain size of 2.00 μm or less by the area fraction method, and a number density of fine second phase particles having a particle diameter of 20 to 30 nm of $1.0\times10^7$ per $mm^2$ or more (Nos. 1 to 4 and 6 to 13) each had an excellent evaluation of B or higher for the etching factor. It was also found that the improvement effect for the etching factor was more stably obtained by increasing the KAM value to 2.20° or more.

On the other hand, the comparative examples each had a low $S_B/S_S$ ratio and were confirmed to exhibit no improvement effect for the etching factor. The contributing factors therefor were considered to be the omission of the intermediate cold rolling in No. 31, the too low rolling reduction ratio in the finish cold rolling in Nos. 32 and 43, the too high temperature in the solution treatment in No. 33, the too long solution treatment time in No. 34, the too high temperature and the too long time of the aging treatment condition resulting in recrystallization in No. 35, the too low elongation ratio in the tension leveler in Nos. 36 and 37, the too high temperature in the low temperature annealing in No. 38, the too long low temperature annealing time in No. 39, the too high hydrogen concentration in the atmosphere gas in the low temperature annealing in No. 40, the too small contents of Ni and Si in the alloy composition in No. 41, and the too large content of Ni in the alloy composition in No. 42. In all the comparative examples, the evaluation of the etching factor was E, and there was no grade D consequently.

REFERENCE SIGN LIST

1: copper alloy sheet material
2: resist film
3: slit
10: rolled surface
101: sheet material specimen (test specimen)

The invention claimed is:

1. A copper alloy sheet material having a chemical composition containing, in terms of percentage by mass, Ni: 1.00 to 4.50%, Si: 0.10 to 1.40%, Co: 0 to 2.00%, Mg: 0 to 0.50%, Cr: 0 to 0.50%, P: 0 to 0.20%, B: 0 to 0.20%, Mn: 0 to 1.00%, Sn: 0 to 1.00%, Ti: 0 to 0.50%, Zr: 0 to 0.30%, Al: 0 to 1.00%, Fe: 0 to 1.00%, Zn: 0 to 1.00%, Ag: 0 to 0.30%, Be: 0 to 0.15%, and balance of Cu, with unavoidable impurities, having an area ratio $S_B/S_s$ of 0.40 or more in an EBSD (electron backscatter diffractometry) measurement in a measurement region provided in a range of from a ¼ sheet thickness position to a ¾ sheet thickness position on a cross section extending in a sheet thickness direction and perpendicular to a rolling direction, wherein $S_s$ represents an area of a region satisfying at least one of a crystal orientation difference from the S1 {241}<112>orientation of 10° or less or a crystal orientation difference from the S2 {231}<124>orientation of 10° or less, and $S_B$ represents an area of a region having a crystal orientation difference from the Brass {011}<211>orientation of 10° or less.

2. The copper alloy sheet material according to claim 1, wherein the copper alloy sheet material has a KAM (Kernel Average Misorientation) value of 2.00° or more measured at a step size of 0.05 μm inside a crystal grain assuming a boundary of a crystal orientation difference of 15° or more in the EBSD measurement as a crystal grain boundary.

3. The copper alloy sheet material according to claim 1, wherein the copper alloy sheet material has an average crystal grain size of 2.00 μm or less obtained by an area fraction method assuming a boundary of a crystal orientation difference of 15° or more in the EBSD measurement as a crystal grain boundary.

4. The copper alloy sheet material according to claim 1, wherein the copper alloy sheet material has a number density of fine second phase particles having a particle diameter of 20 to 30 nm existing in a matrix of the copper alloy sheet material of $1.0\times10^7$ per $mm^2$ or more, and a number density of coarse second phase particles having a particle diameter of 0.5 μm or more existing in the matrix of $5.0\times10^5$ per $mm^2$ or less.

5. The copper alloy sheet material according to claim 1, wherein the copper alloy sheet material has a tensile strength in a direction in parallel to the rolling direction of 600 MPa or more.

6. The copper alloy sheet material according to claim 1, wherein the Co content is 0.50 to 2.00% by mass in the chemical composition.

7. The copper alloy sheet material according to claim 1, wherein the copper alloy sheet material has a sheet thickness of 0.04 to 0.30 mm.

8. A method for producing the copper alloy sheet material according to claim 1, comprising subjecting an intermediate product sheet material to a solution treatment, intermediate cold rolling, an aging treatment, finish cold rolling, pass through a tension leveler, and low temperature annealing, in this order, the solution treatment being performed under a condition of retaining at 780 to 1,060° C. for 10 to 80 seconds, the intermediate cold rolling and the finish cold rolling being performed under a condition satisfying at least one of cold rolling condition A or cold rolling condition B, wherein $R^1$ (%) represents a rolling reduction ratio in the intermediate cold rolling, $R^2$ (%) represents a rolling reduction ratio in the finish cold rolling, and $R^T$ (%) represents a total rolling reduction ratio in the intermediate cold rolling and the finish cold rolling, and wherein for cold rolling condition A, $R_1\geq50\%$, $R_2\geq25\%$, and $R_T\geq75\%$ are satisfied, and for cold rolling condition B, $R_1\geq60\%$, $R_2\geq18\%$, and $R_T\geq90\%$ are satisfied, the aging treatment being performed under a condition causing no recrystallization, before the finish cold rolling, the pass through a tension leveler being performed under a condition providing an elongation ratio of more than 1.5% and 3.7% or less, the low temperature annealing being performed under a condition of retaining at 380 to 550° C. for 10 to 620 seconds in a mixed gas atmosphere of hydrogen gas and an inert gas having a hydrogen concentration of 3 to 13% by volume.

9. The method for producing the copper alloy sheet material according to claim 8, wherein the intermediate product sheet material is a sheet material subjected to hot rolling and then cold rolling.

10. A current-carrying component comprising the copper alloy sheet material according to claim 1.

* * * * *